US011248873B2

(12) United States Patent
Schira

(10) Patent No.: US 11,248,873 B2
(45) Date of Patent: Feb. 15, 2022

(54) SAFING SELECTOR

(71) Applicant: Profense, LLC, Phoenix, AZ (US)

(72) Inventor: Connor Jon Schira, Phoenix, AZ (US)

(73) Assignee: Profense, LLC, Phoenix, AZ (US)

( * ) Notice: Subject to any disclaimer, the term of this patent is extended or adjusted under 35 U.S.C. 154(b) by 0 days.

(21) Appl. No.: 17/046,416

(22) PCT Filed: Apr. 11, 2019

(86) PCT No.: PCT/US2019/027052

§ 371 (c)(1),
(2) Date: Oct. 9, 2020

(87) PCT Pub. No.: WO2019/200150

PCT Pub. Date: Oct. 17, 2019

(65) Prior Publication Data

US 2021/0116206 A1 Apr. 22, 2021

Related U.S. Application Data

(60) Provisional application No. 62/656,165, filed on Apr. 11, 2018.

(51) Int. Cl.

| | |
|---|---|
| ***F41F 1/10*** | (2006.01) |
| ***F41A 35/02*** | (2006.01) |
| ***F41A 3/60*** | (2006.01) |
| ***F41A 9/36*** | (2006.01) |
| ***F41A 19/18*** | (2006.01) |

(52) U.S. Cl.

CPC ..... *F41A 35/02* (2013.01); *F41A 3/60* (2013.01); *F41A 9/36* (2013.01); *F41A 19/18* (2013.01); *F41F 1/10* (2013.01)

(58) Field of Classification Search

CPC .... F41A 35/02; F41A 3/60; F41A 9/36; F41A 19/18; F41F 1/10

USPC ..... 89/9–13.1; 241/167, 241

See application file for complete search history.

(56) References Cited

U.S. PATENT DOCUMENTS

| | | | | |
|---|---|---|---|---|
| 115,393 | A * | 5/1871 | Vaughan | 242/480.3 |
| 116,124 | A * | 6/1871 | Webber | A43C 11/06 24/172 |
| 195,349 | A * | 9/1877 | Cosgrove | B02C 18/0007 241/167 |
| 305,740 | A * | 9/1884 | Clapp | F16K 1/42 251/333 |

(Continued)

*Primary Examiner* — Michael D David

(74) *Attorney, Agent, or Firm* — Richard E. Oney; Venjuris, P.C.

(57) ABSTRACT

A machine gun top cover assembly includes a top cover door attached to a main housing. The top cover assembly defines a rear transverse track section and a front transverse track section for guiding bolt assemblies of the gun. As the machine gun rotor assembly rotates, the rear track section prevents the bolt assemblies from moving into position for firing, and the front track section guides the bolt assemblies into position for firing. A selector switch on the top cover door selects between: (i) a safe position wherein, each of the bolt assemblies are sequentially directed into the rear track section; and (ii) a fire position wherein the bolt assemblies are directed into the front track section. The top cover assembly can include a solenoid for moving the selector switch between the safe position and the fire position in response to an electrical control signal.

20 Claims, 7 Drawing Sheets

(56) References Cited

U.S. PATENT DOCUMENTS

| | | | | | |
|---|---|---|---|---|---|
| 3,766,821 | A * | 10/1973 | Cozzy | F41F 1/10 | 89/12 |
| 4,274,325 | A * | 6/1981 | Snyder | F41F 1/10 | 89/12 |
| 4,359,927 | A * | 11/1982 | Tassie | F41F 1/10 | 89/12 |
| 4,359,928 | A * | 11/1982 | Sawyer | F41F 1/10 | 89/12 |
| 5,065,662 | A * | 11/1991 | Bullis | F41A 19/18 | 89/12 |
| 6,443,044 | B1 * | 9/2002 | Dillon | F41A 9/36 | 89/12 |
| 7,703,374 | B1 * | 4/2010 | Dillon | F41A 17/00 | 89/12 |
| 7,971,515 | B2 * | 7/2011 | Garwood | F41A 9/36 | 89/12 |
| 2005/0115393 | A1 * | 6/2005 | Dillon | F41A 17/00 | 89/12 |
| 2011/0185883 | A1 * | 8/2011 | Garwood | F41A 9/00 | 89/12 |
| 2016/0195349 | A1 * | 7/2016 | Rowe | F41A 35/02 | 89/12 |
| 2016/0305740 | A1 * | 10/2016 | O'Donnell | F41A 19/01 | |

* cited by examiner

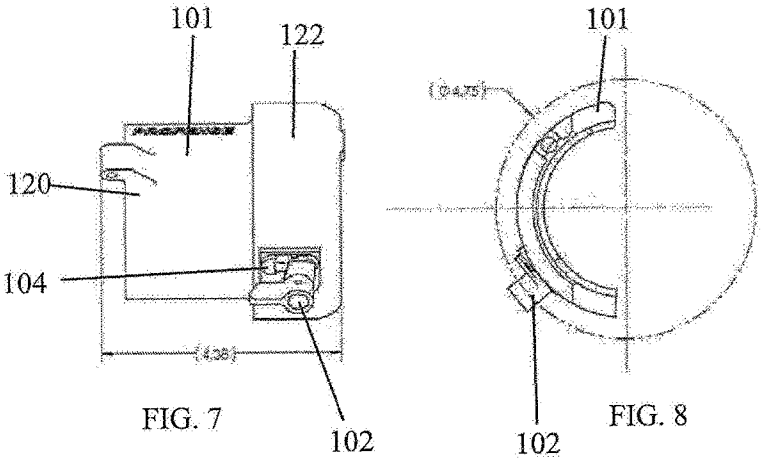
FIG. 8
FIG. 7
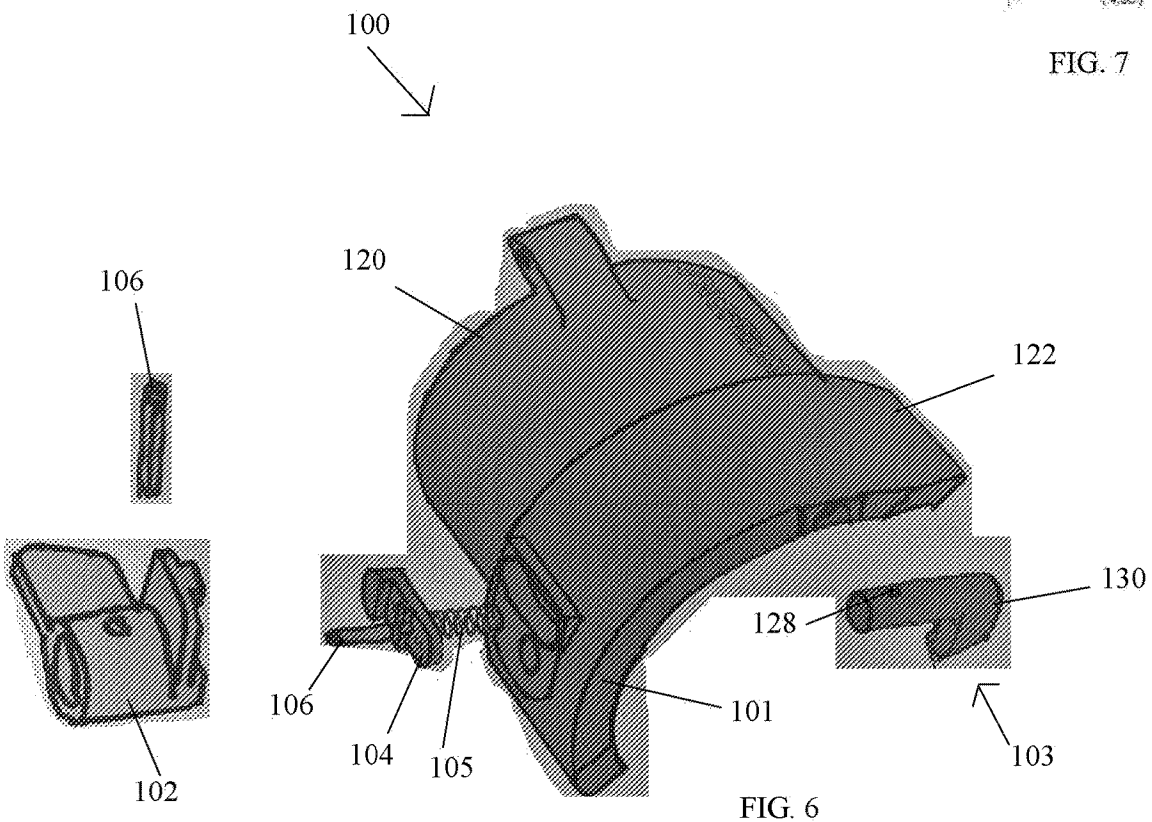
FIG. 6

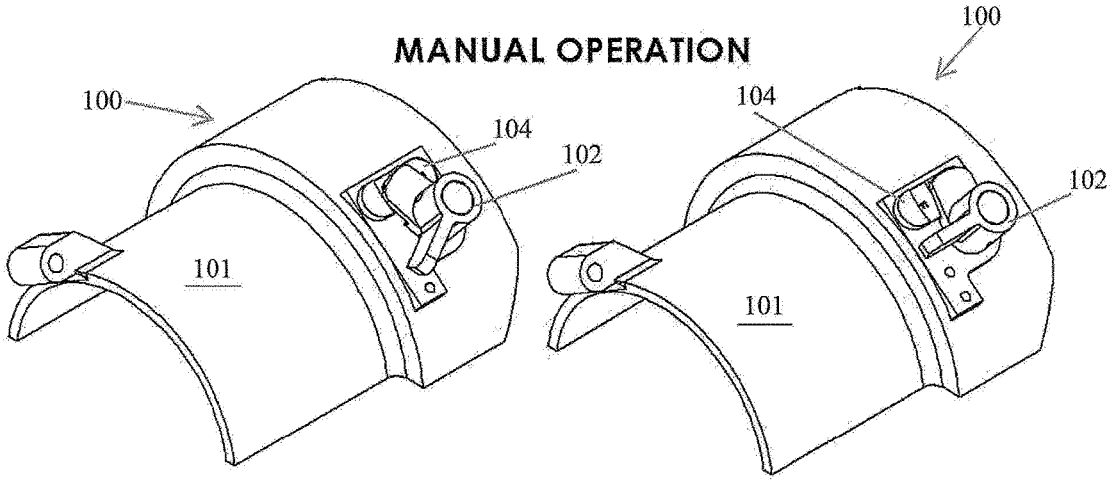
FIG. 9A
FIG. 9B
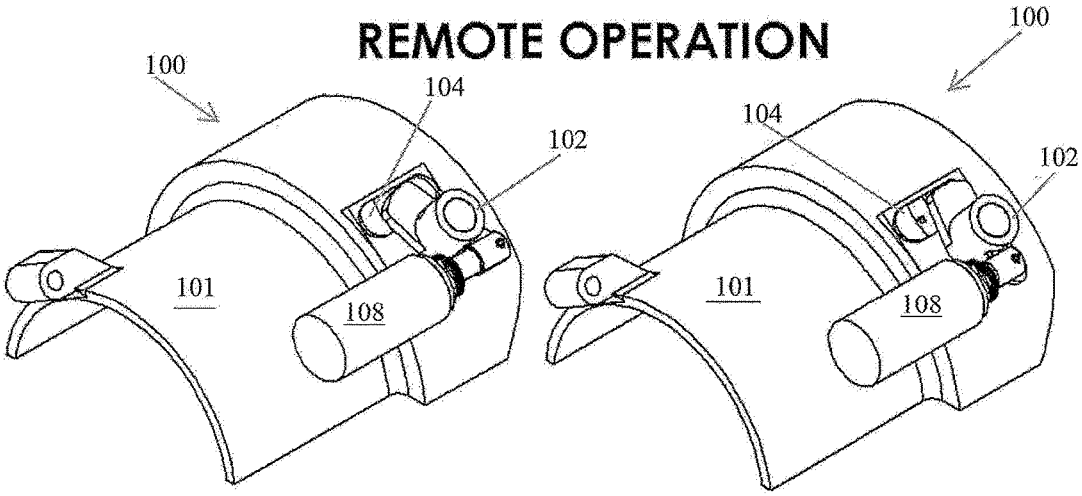
FIG. 10A
FIG. 10B

SAFING SELECTOR

RELATED APPLICATION DATA

This application is based on and claims the benefit of U.S. Provisional Patent Application No. 62/656,165 filed on Apr. 11, 2018, the disclosure of which is incorporated herein in its entirety by this reference.

BACKGROUND

The present invention relates generally to automatic weapons of the Gatling machine gun type. More specifically, it relates to a top cover assembly for such a machine gun that includes a safing selector that makes the machine gun easier to use.

The Gatling-type machine gun is a multi-barreled machine gun with a high rate of fire. It features Gatling-style rotating barrels with an external power source, such as an electric motor. Long existing motivations in the design of Gatling-type miniguns have been to minimize jams, extend the operational life and improve ease of use of such guns.

One Gatling-type machine gun is the M134 minigun, which is a six-barreled, electrically-driven machine gun originally designed and built by General Electric Company in the mid 1960's for the United States military. The M134 minigun (hereinafter referred to as either a minigun or machine gun) utilizes a main housing, which encloses and supports a main rotary body known as a rotor assembly. Cartridges, each of which represents a single round of ammunition, are handled within the main housing by bolt assemblies. The minigun has six bolt assemblies, one associated with each of the six barrels. The six bolt assemblies are slidably attached to and surround the rotor assembly. The rotor assembly comprises the core axis of the minigun. The six barrels are attached to the forward portion of the rotor assembly and are arranged for rotation as a cluster around the core axis of the minigun. As the rotor rotates, the bolt assemblies are driven forward and rearward by a helical track incorporated within the main housing which, in turn, causes cartridges to be delivered to the bolt assemblies, chambered, and fired. The empty cartridges are extracted from the chambers and ejected. The rotor is rotated by a series of gears driven by an electric motor.

FIGS. 1-4 illustrate an assembly of the M134 minigun known in the prior art as the top cover and safing sector assembly. The top cover and safing sector assembly is externally attached to the main housing of the minigun. The safing sector forms a portion of the helical track used to drive the minigun bolt assemblies forward and rearward. The top cover is attached to the safing sector by a hinge pin that allows the top cover to pivot independently of the safing sector. The pivot feature between the top cover and the safing sector allows the top cover to be opened and closed independently of the safing sector. The top cover opens like a hatch to allow the operator access to the inner workings of the minigun. After the top cover has been opened, the safing sector can be either partially or completely removed from the minigun. The purpose of removing the safing sector is to dislocate the critical section of the helical track that causes the bolt assemblies to fire the cartridges. After the safing sector has been partially or completely removed, the minigun cannot be fired, hence the term "safing sector."

Disabling the minigun so that it cannot fire is referred to as "safing" the gun. There are essentially two situations in which it is desirable to safe the gun. The most common is when the minigun is loaded with live cartridges and is not in use. The second situation is when a jam occurs during use of the minigun, causing it to stop firing. In order to safe the gun in either of these situations, a the top cover and safing sector system of FIGS. 1-4 requires the operator to first open the top cover to facilitate removal of the safing sector from its firing position. In a combat or training environment, safing the gun by removing both the top cover and safing sector is time consuming and inconvenient.

Furthermore, when a jam occurs, the operator may be required to remove live cartridges from the rotor assembly without firing them. Doing so requires rotation of the barrels of the minigun. In order to cycle live cartridges through the minigun without firing them, the top cover and safing sector must be removed before rotating the barrels. Following removal of the top cover and safing sector of FIGS. 1-4, the barrels can be rotated manually, but not electrically. If the barrels are inadvertently rotated electrically with the safing sector in its partially or completely open position, the bolt assemblies will be damaged and the minigun will become inoperable. The barrels can only be rotated electrically when the safing sector is in its closed and firing position.

The prior art top cover and safing sector assembly described above and illustrated in FIGS. 1-4 is disadvantageous in that safing the gun requires opening of the top cover and removing the safing sector. Simply opening the top cover does not provide improved safety or functionality. In addition, manual rotation of the hot barrels following recent use of the gun is difficult. Thus, safing a minigun that utilizes the top cover and safing sector of FIGS. 1-4 is at the very least inconvenient when attempting to do so in combat or training environments.

It would therefore be advantageous to provide a replacement for prior art top covers and safing sectors that will enable an operator to safe a minigun without opening the top cover and to rotate the barrels electrically after the minigun has been safed. It is an object of the present invention to provide such a replacement.

It is another object of the present invention to provide a top cover assembly for a Gatling-type multi-barrel machine gun that includes an improved mechanism for safing the weapon, which allows the user to easily switch between "Fire" and "Safe" settings.

It is still another object of the invention to provide a top cover assembly with such a mechanism that can be controlled both manually and remotely.

Additional objects and advantages of the invention will be set forth in the description that follows, and in part will be apparent from the description, or may be learned by practice of the invention. The objects and advantages of the invention may be realized and obtained by means of the instrumentalities and combinations pointed out in the appended claims.

SUMMARY

To achieve the foregoing objects, and in accordance with the purposes of the invention as embodied and broadly described in this document, there is provided a top cover assembly for a Gatling-type machine gun, which gun has a main housing, a rotor assembly supported by the main housing and adapted for being rotated, a plurality of bolt assemblies attached to the rotor assembly, and a helical track extending longitudinally within the main housing for driving the bolt assemblies in forward and rearward directions in response to rotation of the rotor assembly. The top cover assembly includes a top cover door coupled to a portion of the main housing and defining a transverse front track section and a transverse rear track section. In a presently preferred embodiment, the top cover door is hingedly coupled to a portion of the main housing, and each of the front track section and the rear track section is disposed on the inside of the top cover door. A selector switch is positioned on the outside of the top cover door for selecting between: (i) a safe position wherein each of the plurality of bolt assemblies is sequentially directed into the rear track section when the rotor assembly rotates; and (ii) a fire position wherein each of the plurality of bolt assemblies is directed into the front track section when the rotor assembly rotates. The rear track section is configured so that, as the rotor assembly rotates, the rear track section will prevent a bolt assembly from moving into position for firing. The front track section is configured so that, as the rotor assembly rotates, the front track section will guide a bolt assembly to move into position for firing.

In certain advantageous embodiments, the selector switch is coupled to a guide arm disposed on the inside of the top cover door such that: (i) when the selector switch is in the safe position, the guide arm is positioned in a first position to sequentially direct each of the plurality of bolt assemblies into the rear track section as the rotor assembly rotates; (ii) when the selector switch is in the fire position, the guide arm is positioned in a second position to direct a bolt assembly into the front track section as the rotor assembly rotates; and (iii) when the safe selector is moved between the safe position and the fire position, the guide arm is moved between the first position and the second position.

In some embodiments, the top cover assembly includes a selector lock disposed on the top cover door and configured to restrict the selector switch from being rotated between the safe and fire positions unless the selector lock is released.

In some advantageous embodiments, the top cover assembly can be configured for remote operation. For example, in one such embodiment the top cover assembly includes a solenoid configured to actuate movement of the selector switch between the safe position and the fire position in response to an electrical control signal. To provide a fail-safe in the event of a loss of power, the solenoid can be configured to hold the selector switch in the safe position when electric power to the solenoid is removed.

BRIEF DESCRIPTION OF THE DRAWINGS

The accompanying drawings, which are incorporated in and constitute a part of the specification, illustrate the presently preferred embodiments of the invention and, together with the general description given above and the detailed description of the preferred methods and embodiments given below, serve to explain the principles of the invention.

FIG. 6 is an exploded perspective view of the top cover assembly shown in FIG. 5.

FIG. 7 is a top plan view of the top cover assembly shown in FIG. 6.

FIG. 8 is a front elevation view of the top cover assembly shown in FIG. 6.

FIG. 9A is a top perspective view of the top cover assembly of FIG. 6, showing the selector switch in the safe position.

FIG. 9B is a top perspective view of the top cover assembly of FIG. 6, showing the selector switch in the fire position.

FIG. 10A is a top perspective view of an alternative embodiment of a top cover assembly configured for remote operation according to the present invention, showing the selector switch in the safe position.

FIG. 10B is a top perspective view of the top cover assembly of FIG. 10A, showing the selector switch in the fire position.

DESCRIPTION

Figure 1:
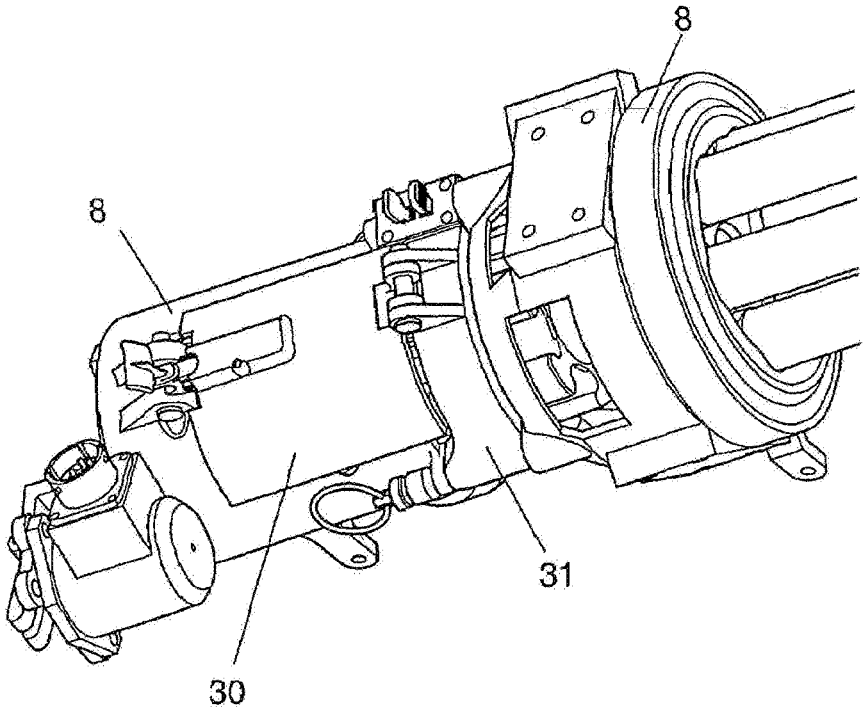
FIG 1 (PRIOR ART)
FIG. 1 is a perspective view of a prior art minigun showing the top cover and safing sector assembly installed on the machine gun main housing.
Figure 2:
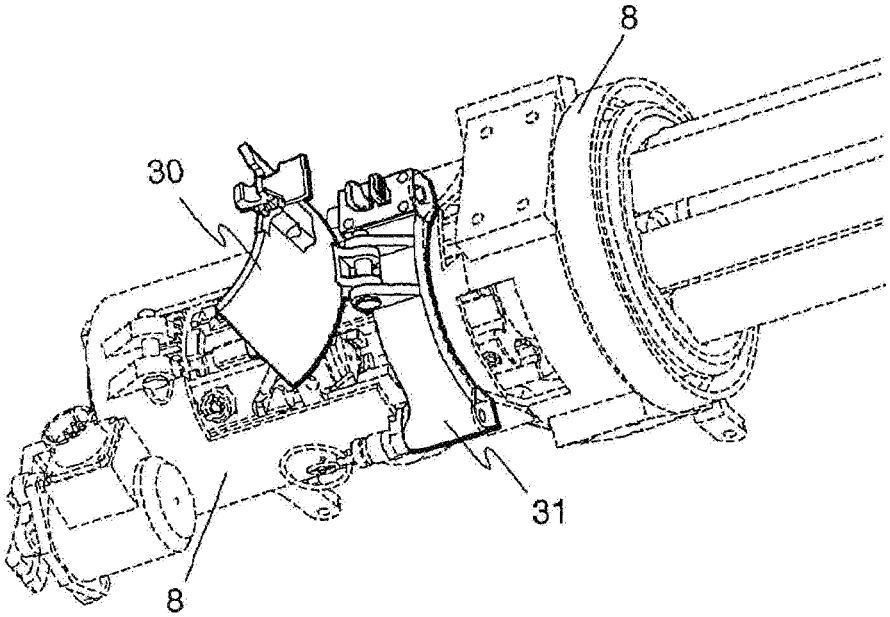
FIG 2 (PRIOR ART)
FIG. 2 is a perspective view of the prior art top cover and safing sector assembly of FIG. 1, illustrating the top cover in its open position.
Figure 3:
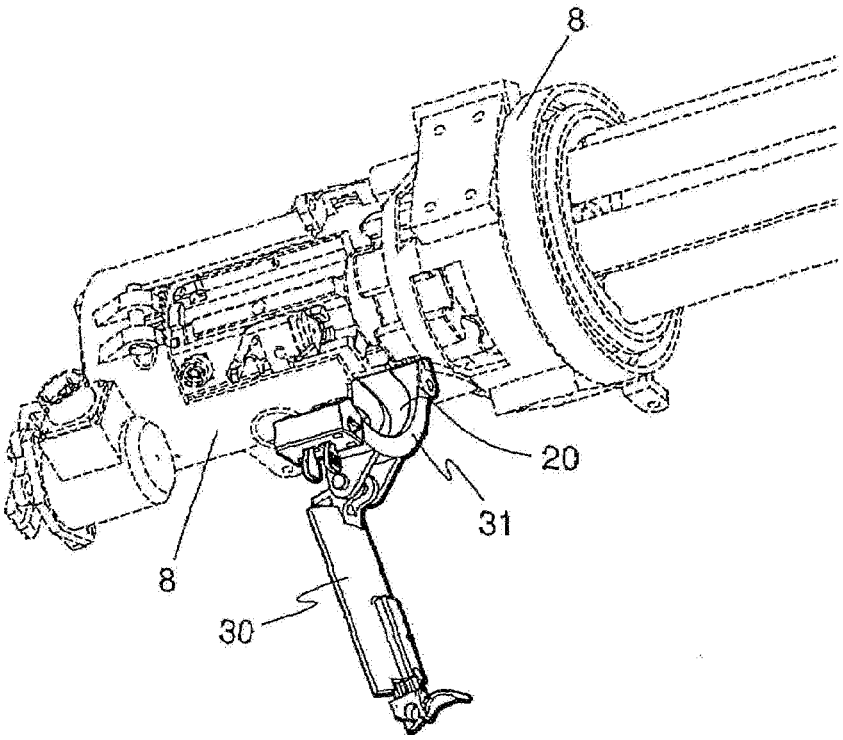
FIG 3 (PRIOR ART)
FIG. 3 is a perspective view of the prior art top cover and safing sector assembly of FIG. 1, illustrating both the top cover and the safing sector in their open positions.
Figure 4:
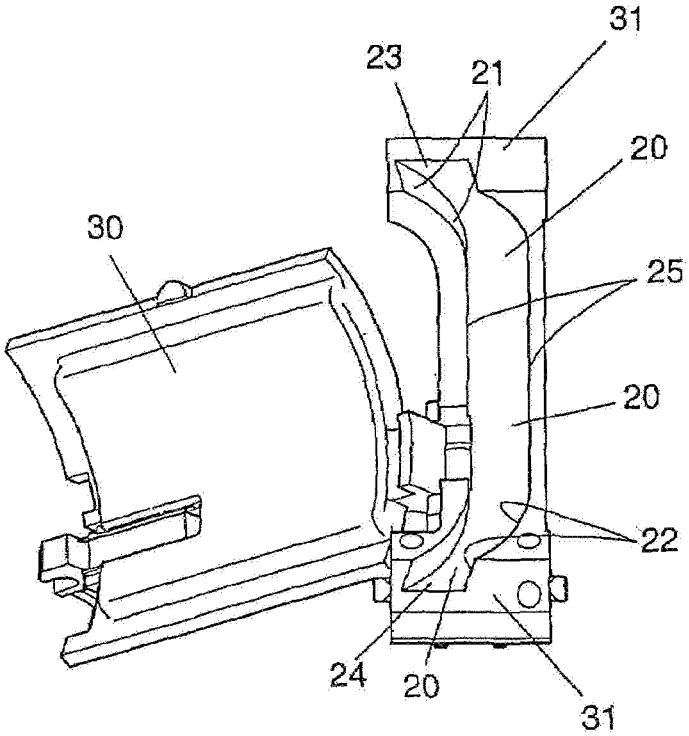
FIG 4 (PRIOR ART)
FIG. 4 is a perspective view of the underside of the prior art top cover and safing sector assembly of FIG. 1 removed from the minigun main housing.

Referring generally to FIGS. 1-4, there is shown a prior art top cover 30 and safing sector 31 and the way in which they are hingedly connected adjacent each other and to a main housing 8 of a conventional minigun. A helical track extends longitudinally within the main housing 8 and forms a continuous track with a track section 20 that is formed in the underside of the safing sector 31, as illustrated in FIGS. 3 and 4. Conventional bolt assemblies each include a roller bearing that rides in the helical track through the safing sector track section 20. As the barrels of the minigun rotate, the roller bearing enters the track section 20 at location 23 of FIG. 4 and exits the track section 20 at location 24. The safing sector track section 20 includes forward and aft camming portions 21, 22, respectively. The camming portions 21, 22 of the safing sector track section 20 are both bearing surfaces that force the bolt assemblies in forward and aft directions, respectively. A straight portion of the track section 20, illustrated by sidewalls 25 of FIG. 4, serves as a guide between forward and aft camming portions 21, 22 and does not produce a camming action.

Still referring to FIG. 4, as each of the bolt assemblies enters the safing sector track section 20 at location 23 and is forced forward by the forward camming portion 21, the firing pin of each bolt assembly is placed under heavy spring pressure in preparation for firing a respective cartridge. Just before the bolt assembly crests forward of the camming portion 21 of the track section 20 and enters the straight portion thereof defined by the sidewalls 25, the cartridge is fired and the spring pressure is released. The bolt assembly continues through the straight portion of track section 20 until reaching the aft camming portion 22 of the track section 20, at which point the bolt assembly is forced in the aft direction, guiding the bolt assembly back into the portion of the helical track within main housing 8. It is the forward camming portion 21 of the safing sector track section 20 that causes the cartridge to be fired and the aft camming portion 22 of track section 20 that redirects the bolt assembly and guides it back into the helical track within main housing 8. When safing the gun by removing the safing sector 31, it is the removal of forward camming portion 21 of track section 20 that inhibits the minigun from firing. When the safing sector 31 is removed, the aft camming portion 22 of the track section 20 is also removed and the bolt assembly will not be properly guided back into the portion of helical track within main housing 8 by aft camming portion 22. Consequently, inadvertently rotating the barrels electrically with the safing sector open can damage the bolt assemblies.

Figure 5:
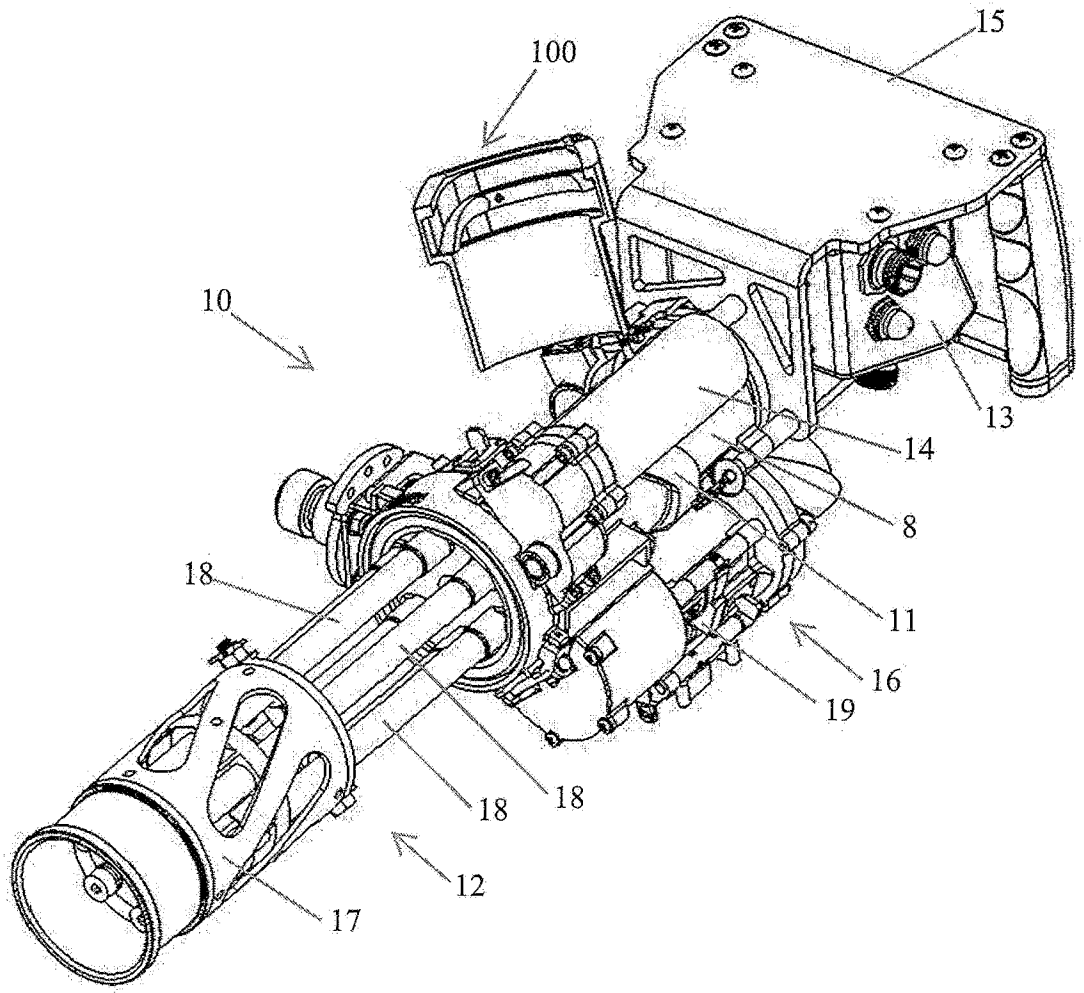
FIG. 5 is a perspective view of an electrically-powered Gatling-type machine gun that includes a top cover assembly having a safing selector according to the present invention, showing the top cover in an open position.

FIG. 5 illustrates a Gatling-type machine gun 10 suitable for use with the present invention. The Gatling-type machine gun 10 includes a barrel assembly 12, an electric drive motor 14 to rotate the barrel assembly 12, a delinking feeder 16, a clutch assembly (not shown), a gun main housing 8, a gun control unit 13, and a spade grip 15. The barrel assembly 12 includes a barrel clamp assembly 17 to which a plurality of barrels 18 are circumferentially mounted. In the context of the specification, the terms "rear" or "rearward" mean in the direction towards the chamber end of the barrels 18, while the terms "front" or "forward" mean in the direction towards the muzzle end of the barrels 18.

Still referring to FIG. 5, ammunition is fired sequentially through the barrels 18 in a known fashion, i.e., first one barrel is used, then the next, then the next, etc. An electric cable (not shown) supplies power from the gun control unit 13 to the drive motor 14. The delinking feeder 16, which is an ammunition feed device, is engaged and disengaged via the electric cable. To provide access to the interior of the delinking feeder 16, an access door assembly 19 is mounted on the delinking feeder 16. The access door assembly 19 includes an access door that is movable between a first closed operative position and a second open position to facilitate the loading of an ammunition belt of linked cartridges (not shown).

As is well known to those of skill in the art, in the operation of the minigun 10, the drive motor 14 causes the barrel assembly 12 to rotate, and each barrel 18 fires sequentially in rapid succession. During such operation, the delinking feeder 16 receives the ammunition belt of linked cartridges, sequentially separates or "delinks" the cartridges from the ammunition belt and feeds the cartridges to a receiver in the main housing 8 for firing. A helical cam track 11 extends longitudinally within the main housing 8 and guides each bolt assembly from a rear position where the cartridge is fed into the receiver to a forward position where the bolt compresses, causing the head to rotate, lock and fire the cartridge. Each bolt assembly includes a roller bearing that rides in the helical track 11 and forces the bolt assembly into the required positions.

Still referring to FIG. 5, when an arming switch on the gun control unit 13 is activated, and one or both firing buttons are then depressed, the gun will fire. When the firing buttons are released, the delinking feeder 16 is disengaged so the ammunition supply is discontinued. The electric drive motor 14 continues to rotate for a short period of time so that the weapon is cleared of remaining ammunition before stopping. A booster motor override control button on the gun control unit 13, when depressed, activates an ammunition booster motor on the ammunition magazine (not shown) to facilitate the loading of the weapon. The booster motor pushes the ammunition belt from the ammunition magazine, through the feed chute, and to the weapon where it is inserted in the delinking feeder 16, readying the weapon for firing.

In accordance with the present invention, the machine gun 10 includes a novel top cover assembly, generally designated by the reference numeral 100. Referring to FIGS. 6-12, on one embodiment, the top cover assembly 100 includes a top cover door 101 having a rearward end 120 and a forward end 122. The top cover door rearward end 120 is hingedly connected to the main housing 8 of the machine gun. On the underside of the top cover door forward end 122 are two transverse track sections, i.e., a front track section 124 and a rear track section 126. A selector switch 102 is positioned on the outside of the top cover door 101 and is mounted to a track selector 103 (see FIG. 6) so that the selector switch 102 and track selector 103 can be rotated together between a safe position (as shown in FIG. 9A) and a fire position (as shown in FIG. 9B). The track selector 103 is generally L-shaped (see FIG. 6) and includes a shaft 128 that extends through a hole 108 (see FIG. 12) in the top cover door 101 and a guide arm 130 that is disposed on the inside (i.e., the underside) of the top cover door 101. The selector switch 102 is mounted on the track selector shaft 128 with a slotted pin 106 and is disposed on the outside of the top cover door 101. A selector lock 104 is mounted to the top cover door 101 on another pin 106 that fits within another hole 109 in the top cover door 101. The selector lock 104 floats within a slot 110 in the top cover door 101. A compression spring 105 fits over the slotted pin 106 and forces the selector lock 104 outward into engagement with the selector switch 102 such that it restricts the selector switch 102 from being rotated between the safe and fire positions unless the selector lock 104 is first depressed. In this configuration, the selector lock 104 cannot be removed unless the selector switch 102 is first removed.

Figure 11A:
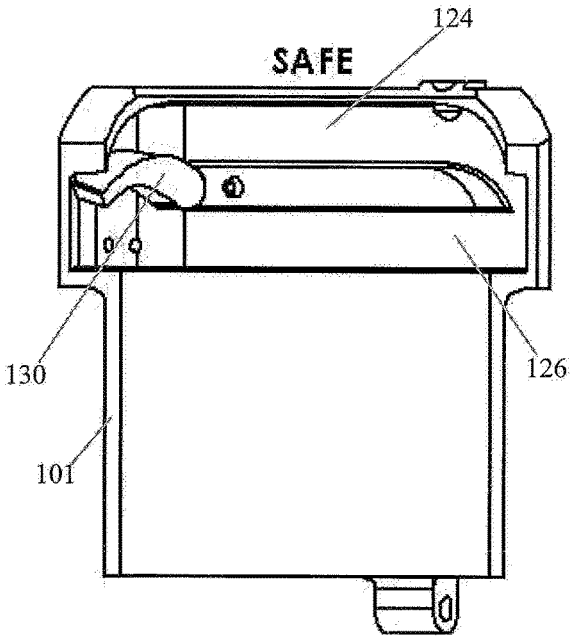
FIG. 11A is a bottom plan view of a top cover assembly according to the present invention, showing the position of the track selector when the selector switch is in the safe position.

Referring to FIGS. 9-11, when the track selector switch 102 is in the safe position as shown in FIGS. 9A and 10A, the track selector guide arm 130 is disposed as shown in FIG. 11A. In this position, as the barrel assembly 12 rotates, each of the bolt assembly roller bearings is directed into the rear track section 126, which prevents the bolt assemblies from fully compressing and thereby prevents the minigun from firing. As the barrel assembly 12 continues to rotate, the rear track section 126 guides the bolt assembly back into the helical track 11 within main housing 8.

Figure 11B:
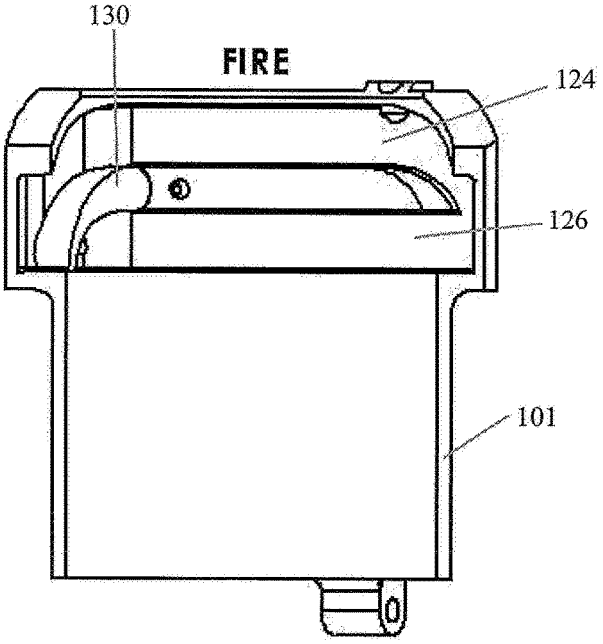
FIG. 11B is a bottom plan view of a top cover assembly according to the, present invention, showing the position of the track selector when the selector switch is in the fire position.
Figure 12:
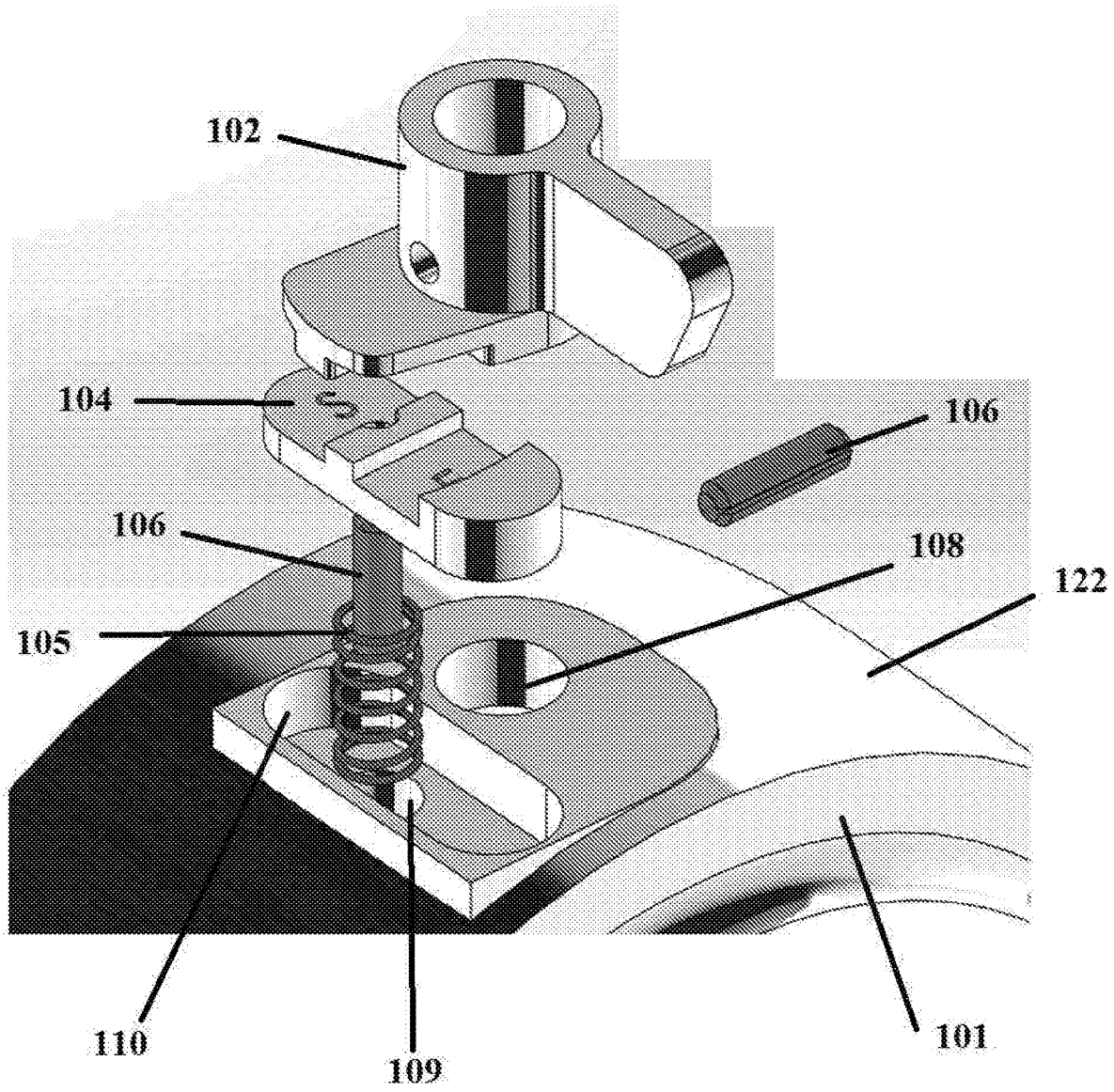
FIG. 12 is an enlarged exploded view showing a selector lock in relationship to the selector switch of the top cover assembly of FIG. 6.

When the track selector switch 102 is rotated to the fire position as shown in FIGS. 9B and 10B, the track selector 103 and guide arm 130 rotate to the position shown in FIG. 11B. In this position, as the barrel assembly 12 rotates, each of the bolt assembly roller bearings is directed into the front track section 124, which forces the bolt assembly to move in a forward direction and thereby compresses the bolt, causing the head to rotate, lock and fire the cartridge, as described above. As the barrel assembly 12 continues to rotate, the front track section 124 guides the bolt assembly back into the helical track 11 within the main housing 8. When the selector switch 102 is in either of the safe or firing positions, the selector lock 104 will prevent the selector switch 102 from disengaging and moving between positions without operator input. To move the selector switch 102 between positions, the operator must first depress the spring-loaded selector lock 104.

According to one advantageous aspect of the present invention, the top cover assembly 100 can be configured for remote operation. In one such configuration, shown in the embodiment of FIGS. 10A and 10B, remote operation of the selector switch 102 is actuated by a solenoid 108, which is managed from the gun control unit 13. The top cover assembly 100 does not include a selector lock 104. The solenoid 108 is configured to actuate movement of the selector switch 102 between the safe position and the fire position in response to an electrical control signal, which is received from the gun control unit 13. The selector switch 102 is in the safe mode when the plunger of the solenoid 108 is extended (see FIG. 10A) and is in fire mode when the plunger of the solenoid 108 is retracted (see FIG. 10B). When the solenoid 108 is not receiving power from the gun control unit 13, an internal return spring will extend the solenoid plunger in order to default the system to its safe mode. As the gun control unit 13 runs through its process, when it cuts power to the solenoid 108 an internal solenoid spring will force the assembly into the safe position. This also provides a fail-safe in the event of a loss of power.

Upon reading this disclosure, those skilled in the art will appreciate that various changes and modifications may be made to the preferred embodiments of the invention and that such changes and modifications may be made without departing from the spirit of the invention. Therefore, the invention in its broader aspects is not limited to the specific details, representative devices, and illustrative examples shown and described. Accordingly, departures may be made from such details without departing from the spirit or scope of the general inventive concept.

What is claimed is:

1. A top cover assembly for a machine gun having a main housing, a rotor assembly supported by the main housing and adapted for being rotated, a plurality of bolt assemblies attached to the rotor assembly, and a helical track extending longitudinally within the main housing for driving the bolt assemblies in forward and rearward directions in response to rotation of the rotor assembly, the top cover assembly comprising:

a top cover door coupled to a portion of the main housing and defining a transverse front track section and a transverse rear track section; and a selector switch for selecting between: (i) a safe position wherein, as the rotor assembly rotates, each of the plurality of bolt assemblies will be sequentially directed into the rear track section and not into the front track section; and (ii) a fire position wherein, as the rotor rotates, each of the plurality of bolt assemblies will be sequentially directed into the front track section;

wherein the rear track section is configured to prevent a bolt assembly from moving into position for firing as the rotor assembly rotates; and wherein the front track section is configured to guide a bolt assembly into position for firing as the rotor assembly rotates.

2. The top cover assembly of claim 1 wherein the top cover door is hingedly coupled to a portion of the main housing.

3. The top cover assembly of claim 1 wherein each of the front track section and the rear track section is disposed on the inside of the top cover door.

4. The top cover assembly of claim 1 wherein the selector switch is positioned on the outside of the top cover door.

5. The top cover assembly of claim 1 further comprising a selector lock disposed on the top cover door and configured to restrict the selector switch from being rotated between the safe the fire positions unless the selector lock is released.

6. The top cover assembly of claim 5 wherein the selector lock is disposed within a slot in the top cover door.

7. The top cover assembly of claim 1 wherein the selector switch is coupled to a guide arm disposed on the inside of the top cover door such that: (i) when the selector switch is in the safe position, the guide arm is positioned in a first position to sequentially direct each of the plurality of bolt assemblies into the rear track section as the rotor assembly rotates; (ii) when the selector switch is in the fire position, the guide arm is positioned in a second position to direct a bolt assembly into the front track section as the rotor assembly rotates; and (iii) when the selector switch is moved between the safe position and the fire position, the guide arm is moved between the first position and the second position.

8. A top cover assembly for a machine gun having a main housing, a rotor assembly supported by the main housing and adapted for being rotated, a plurality of bolt assemblies attached to the rotor assembly, and a helical track extending longitudinally within the main housing for driving the bolt assemblies in forward and rearward directions in response to rotation of the rotor assembly, the top cover assembly comprising:

a top cover door attached to a portion of the main housing and having a forward end that defines a front track section and a rear track section;

a selector switch for selecting between: (i) a safe position wherein each of the plurality of bolt assemblies is directed into the rear track section and not into the front track section; and (ii) a fire position wherein each of the plurality of bolt assemblies is directed into the front track section; and a solenoid configured to actuate movement of the selector switch between the safe position and the fire position in response to an electrical control signal;

wherein the rear track section is configured to prevent a bolt assembly from moving into position for firing as the rotor assembly rotates; and wherein the front track section is configured to force a bolt assembly to move into position for firing as the rotor assembly rotates.

9. The top cover assembly of claim 8 wherein the top cover door is hingedly coupled to a portion of the main housing.

10. The top cover assembly of claim 8 wherein the selector switch is positioned on the outside of the top cover door.

11. The top cover assembly of claim 8 wherein the solenoid is configured to hold the selector switch in the safe position when electric power to the solenoid is removed.

12. The top cover assembly of claim 8 wherein the solenoid electrical control signal is received from a gun control unit of a machine gun.

13. A machine gun comprising:

a main housing;

a rotor assembly supported by the main housing and adapted for being rotated;

a plurality of bolt assemblies coupled to the rotor assembly;

a helical track extending longitudinally within the main housing for driving the bolt assemblies in forward and rearward directions in response to rotation of the rotor assembly; and a top cover assembly comprising a top cover door coupled to a portion of the main housing and defining a transverse front track section and a transverse rear track section; and a selector switch for selecting between: (i) a safe position wherein, as the rotor assembly rotates, each of the plurality of bolt assemblies is sequentially directed from the helical track into the rear track section and not into the front track section; and (ii) a fire position wherein, as the rotor assembly rotates, each of the plurality of bolt assemblies is sequentially directed from the helical track into the front track section;

wherein the rear track section is configured to prevent a bolt assembly from moving into a position for firing as the rotor assembly rotates; and wherein the front track section is configured to force a bolt assembly to move into a position for firing as the rotor assembly rotates.

14. The machine gun of claim 13 wherein top cover door is hingedly coupled to a portion of the main housing.

15. The machine gun of claim 13 wherein the selector switch is positioned on the outside of the top cover door.

16. The machine gun of claim 13 wherein the selector switch is coupled to a guide arm disposed on the inside of the top cover door such that: (i) when the selector switch is in the safe position, the guide arm is positioned in a first position to sequentially direct each of the plurality of bolt assemblies into the rear track section as the rotor assembly rotates; (ii) when the selector switch is in the fire position, the guide arm is positioned in a second position to direct a bolt assembly into the front track section as the rotor assembly rotates; and (iii) when the selector switch is moved between the safe position and the fire position, the guide arm is moved between the first position and the second position.

17. The machine gun of claim 13 further comprising a selector lock disposed on the top cover door and configured to restrict the selector switch from being moved between the safe and fire positions unless the selector lock is released.

18. The machine gun of claim 13 further comprising a solenoid configured to actuate movement of the selector switch between the safe position and the fire position in response to an electrical control signal.

19. The machine gun of claim 18 further comprising a gun control unit, wherein the solenoid electrical control signal is received from the gun control unit.

20. The machine gun of claim 18 wherein the solenoid is configured to hold the selector switch in the safe position when electric power to the solenoid is removed.

* * * * *